US006941684B2

(12) United States Patent
Auger et al.

(10) Patent No.: US 6,941,684 B2
(45) **Date of Patent: *Sep. 13, 2005**

(54) ARTICLE OF FOOTWEAR WITH A REPLACEABLE GROUND-ENGAGING MEMBER AND METHOD OF ATTACHING THE GROUND-ENGAGING MEMBER

(75) Inventors: Perry Auger, Tigard, OR (US); Troy Lindner, Beaverton, OR (US); Peter A. Hudson, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/781,882

(22) Filed: Feb. 20, 2004

(65) Prior Publication Data

US 2004/0159021 A1 Aug. 19, 2004

Related U.S. Application Data

(63) Continuation of application No. 09/988,737, filed on Nov. 20, 2001, now Pat. No. 6,722,061.

(51) Int. Cl.[7] ..... A43B 5/00
(52) U.S. Cl. ..... 36/136; 36/67 D
(58) Field of Search ..... 36/134, 67 R, 36/67 D, 36 B

(56) References Cited

U.S. PATENT DOCUMENTS

| | | | |
|---|---|---|---|
| 1,366,518 | A | 1/1921 | Buchman |
| 1,676,332 | A | 7/1928 | Hoffman |
| 2,734,288 | A | 2/1956 | Phillips et al. |

(Continued)

FOREIGN PATENT DOCUMENTS

| | | | |
|---|---|---|---|
| DE | 613 384 | C | 8/1935 |
| EP | 1 068 813 | A | 1/2001 |
| EP | 1 250 860 | A | 10/2002 |
| WO | WO 99 53790 | A | 10/1999 |

OTHER PUBLICATIONS

Fogdog Sports, webpage, Fogdog Products Guide—Making the Right Choices—Expert Advise How to Buy Soccer Cleats, 7 sheets, Oct. 2000.

Fogdog Sports, webpage, Soccer, Stadio Elite Replaceable by Lotto, 3 sheets, Oct. 2000.

Fogdog Sports, webpage, Soccer, Volante Pro Replaceable Cleats by Puma, 2 sheets, Oct. 2000.

Fogdog Sports, webpage, Soccer, Scudetto SC by Diadora, 2 sheets, Oct. 2000.

Fogdog Sports, webpage, Soccer, King Replaceable by Puma, 2 sheets, Oct. 2000.

Fogdog Sports, Webpage, Soccer, Tiempo Premier SG by Nike, 2 sheets, Oct. 2000.

Fogdog Sports, webpage, Soccer, Stadio Elite Replaceable by Lotto, 3 sheets, Oct. 2000.

Fogdog Sports, Webpage, Soccer, Goldline Screw in by Patrick, 2 sheets, Oct. 2000.

(Continued)

*Primary Examiner*—M. D. Patterson
(74) *Attorney, Agent, or Firm*—Banner & Witcoff, Ltd.

(57) ABSTRACT

An article of footwear provided with snap-fit replaceable ground-engaging members, particularly snap-fit tips, and a kit and method for altering ground-engaging characteristics of an article of footwear such as an athletic shoe. An article of footwear according to the present invention includes a sole (and/or a footplate) having at least one ground-engaging member in snap-fit engagement therewith. In particular, the ground-engaging member is engageable under the application of a non-rotational force (especially a manual force). According to one aspect of the present invention, a clearly discernible feedback (especially an audible feedback, such as a click or a snapping sound) is provided to clearly indicate engagement between the ground-engaging member and the sole.

16 Claims, 10 Drawing Sheets

U.S. PATENT DOCUMENTS

| | | | | | |
|---|---|---|---|---|---|
| 3,267,593 | A | | 8/1966 | Turner | |
| 3,351,967 | A | | 11/1967 | Dardig | |
| 3,442,033 | A | | 5/1969 | Hilburn, Jr. | |
| 3,526,976 | A | | 9/1970 | Jacobs | |
| 3,566,489 | A | | 3/1971 | Morley | |
| 3,715,817 | A | | 2/1973 | White et al. | |
| 3,738,026 | A | | 6/1973 | Granger | |
| 4,035,934 | A | | 7/1977 | Hrivnak | |
| 4,306,360 | A | | 12/1981 | Hagger | |
| 4,414,763 | A | | 11/1983 | Bente | |
| 4,633,600 | A | | 1/1987 | Dassler et al. | |
| 4,644,672 | A | | 2/1987 | Dassler et al. | |
| 5,123,184 | A | | 6/1992 | Ferreira | |
| 5,321,901 | A | | 6/1994 | Kelly | |
| 5,361,518 | A | | 11/1994 | Sussmann et al. | |
| 5,628,129 | A | * | 5/1997 | Kilgore et al. | 36/134 |
| 5,638,615 | A | | 6/1997 | Korsen | |
| 5,655,317 | A | * | 8/1997 | Grant | 36/134 |
| 5,836,090 | A | * | 11/1998 | Smith | 36/7.6 |
| 5,848,482 | A | | 12/1998 | Bathum | |
| 5,875,572 | A | * | 3/1999 | Redburn | 36/134 |
| 5,960,568 | A | | 10/1999 | Bell et al. | |
| 6,154,984 | A | * | 12/2000 | Adam | 36/134 |
| 6,260,292 | B1 | | 7/2001 | Swedick et al. | |
| 6,513,266 | B1 | | 2/2003 | Ijiri | |
| 6,722,061 | B2 | * | 4/2004 | Auger et al. | 36/136 |

OTHER PUBLICATIONS

MacNeill Engineering Worldwide, webpage, Spke Fastening Systems, 2 sheets, (date unknown, but prior to filing of this application).

Champ Accessories, Champ is an Accessory to your Golf Sales, 1 sheet, (date unknown, but prior to filing of this application).

Champ, Sport Cleats & Spikes, 4 sheet, (date unknown, but prior to filing of this application).

Champ, Advertisement, Champ Q–Lok System (date unknown, but prior to the filing date of this application).

* cited by examiner

ARTICLE OF FOOTWEAR WITH A REPLACEABLE GROUND-ENGAGING MEMBER AND METHOD OF ATTACHING THE GROUND-ENGAGING MEMBER

CROSS-REFERENCE TO RELATED APPLICATION

This application is a Continuation of U.S. patent application Ser. No. 09/988,737 filed Nov. 20, 2001, now U.S. Pat. No. 6,722,061 which is hereby incorporated by reference.

FIELD OF THE INVENTION

The present invention relates to an article of footwear having one or more ground-engaging members, especially an athletic shoe having one or more selectively alterable ground-engaging members (such as spikes, cleats, etc.).

BACKGROUND OF THE INVENTION

It is generally known to provide one or more protruding ground-engaging members on the sole of a shoe, especially on the sole of an athletic shoe for activities such as golf, soccer, track, baseball, and "American-style" football. Such ground-engaging members are variously known in the art as cleats, spikes, studs, leaves, blades, triangles, nubs, etc., and generally serve to increase traction between the shoe and the ground surface.

Furthermore, it is conventionally known to use particular types of ground-engaging members for certain types of playing surfaces. For example, molded cleats made from hard rubber or a thermoplastic material are commonly used on hard/firm natural ground surfaces (e.g., hard dirt). Relatively smaller molded rubber nubs are commonly used on artificial turf and the like. Also, relatively thin spikes are conventionally used in golf and in track.

For activities taking place on soft ground (e.g., wet fields, soggy grass, or muddy ground), it is generally known to use removable ground-engaging members. This is done to enable the user to use differed sized ground-engaging members based on the type of field being played on, and the condition of the field. Conventional removable ground-engaging members are typically engaged with a shoe sole by way of cooperating screw threads or other rotational engagement.

When conventional removable ground-engaging members are provided with screw threads for engagement with a shoe, a separate tool is used to manually rotate a ground-engaging member to attach and remove the ground-engaging members as desired. This is generally time consuming and labor intensive, and is also problematic if a user decides to change ground-engaging members in a hurried manner, such as during the course of a game, for example.

Furthermore, conventional removable ground-engaging members must be adequately rotationally tightened so as to ensure good engagement between the shoe and the ground-engaging member. However, it is conventionally difficult to recognize when the ground-engaging member has been adequately tightened. Thus, the ground-engaging member may be inadvertently over-torqued in an attempt to ensure good engagement. This can damage the screw threads on the shoe and/or on the ground-engaging member, making it difficult or even impossible to subsequently disengage the ground-engaging member from the shoe when desired. On the other hand, the ground-engaging member may be inadvertently under-torqued (for example, to avoid damage caused by over-torquing). When this occurs, the ground-engaging member may not function as a stable traction device and/or may become loose and be susceptible to falling off of the shoe.

While some conventional ground-engaging members are not threadedly engaged with a shoe, they still suffer from structural and/or functional problems. In particular, some existing non-threaded ground-engaging members are free to rotate relative to the sole. This can be a problem when, for example, the ground-engaging member is axially asymmetrical in shape (for example, conical or frusto-conical) because free edges of an axially asymmetrical ground-engaging member can become exposed, caught on objects and such, and be torn away. Furthermore, relative movement between a ground-engaging member and a sole generally destabilizes the engagement between the ground-engaging member and the sole, compared to holding them fixed relative to one another.

Also, some existing ground-engaging members use a receiving portion or the like mounted on an exterior surface of the shoe sole. Thus, the receiving portion may possibly be sheared off the sole or may otherwise become dislodged.

BRIEF SUMMARY OF THE INVENTION

The present invention is generally directed to an article of footwear (such as a shoe, and especially, but not necessarily only, an athletic shoe like a cleated soccer shoe) having a selectively alterable ground-engaging member engaged with a sole of the article of footwear, and a kit and method for altering ground-engaging characteristics of an article of footwear.

A ground-engaging member according to the present invention is preferably engaged with the sole in a non-rotational manner, such as by simply applying a substantially non-rotational linear force to engage the ground-engaging member with the sole. Such a non-rotational action can be ensured, for example, by providing a rotation preventing mechanism. For example, a rib, spline, ridge, etc. may be provided on one of the ground-engaging member and a corresponding portion of the sole, and a slot, groove, etc. is provided in the other of the ground-engaging member and the corresponding portion of the sole. The rib and slot cooperate in the process of engaging the ground-engaging member with the sole so the ground-engaging member can only be linearly moved into engagement with the sole, with substantially no relative rotation therebetween. Once the ground-engaging member is engaged with the sole, the rotation prevention mechanism additionally prevents subsequent relative rotation between the ground-engaging member and the sole.

According to one example of the present invention, one of the sole and the ground-engaging member includes a resilient spring assembly, and the other of the sole and the ground-engaging member includes a leg assembly having legs sized and arranged to resiliently retain the spring assembly therebetween.

When a ground-engaging member according to the present invention is engaged with the sole according to the present invention, it is desirable to provide a detectible feedback to indicate that the ground-engaging member is properly engaged with the sole. In a particular (but not exclusive) example of the present invention, the detectible feedback is an audible feedback (such as, without limitation, a snapping sound or a click sound) that a user can hear when the ground-engaging member is properly engaged with the sole. For example, in the above-described arrangement including spring and leg assemblies, the legs initially resiliently deflect the spring assembly. Subsequently, the spring assembly resiliently recovers, preferably in an audible manner, such as with a snap or click. Therefore, the spring assembly is resiliently retained between the legs of the leg assembly.

A ground-engaging member according to the present invention may include a selectively removable tip that is engaged with a portion of the sole in accordance with the foregoing description. Furthermore, each portion of the sole may be engageable with several such tips, at least some of which have different heights, such that a given tip may be replaced with another tip having a different height. In this manner, the characteristics (especially, but not necessarily only, ground-engaging characteristics) of the article of footwear may be adjusted quickly and assuredly in accordance with changing playing conditions by avoiding the time-consuming conventional process of using a screw tool to engage and disengage conventional ground-engaging members, while additionally permitting sure engagement of a ground-engaging member because of the detectible feedback provided in accordance with the present invention.

As mentioned above, the ground-engaging member can be engaged with a sole using a simple, non-rotational pressing force (especially, but not necessarily only, a manual pressing force). Conversely, the ground-engaging member according to the present invention can be disengaged using a simple prying tool. The prying tool may be specially associated with a respective ground-engaging member. However, it may be desirable to be able to use any suitable conventional article as a prying tool, including, for example and without limitation, a screwdriver blade, a coin, and a knife blade.

BRIEF DESCRIPTION OF THE DRAWINGS

The present invention will be described in detail hereinbelow with reference to the attached drawings, in which.

DETAILED DESCRIPTION OF THE INVENTION

Figure 1:
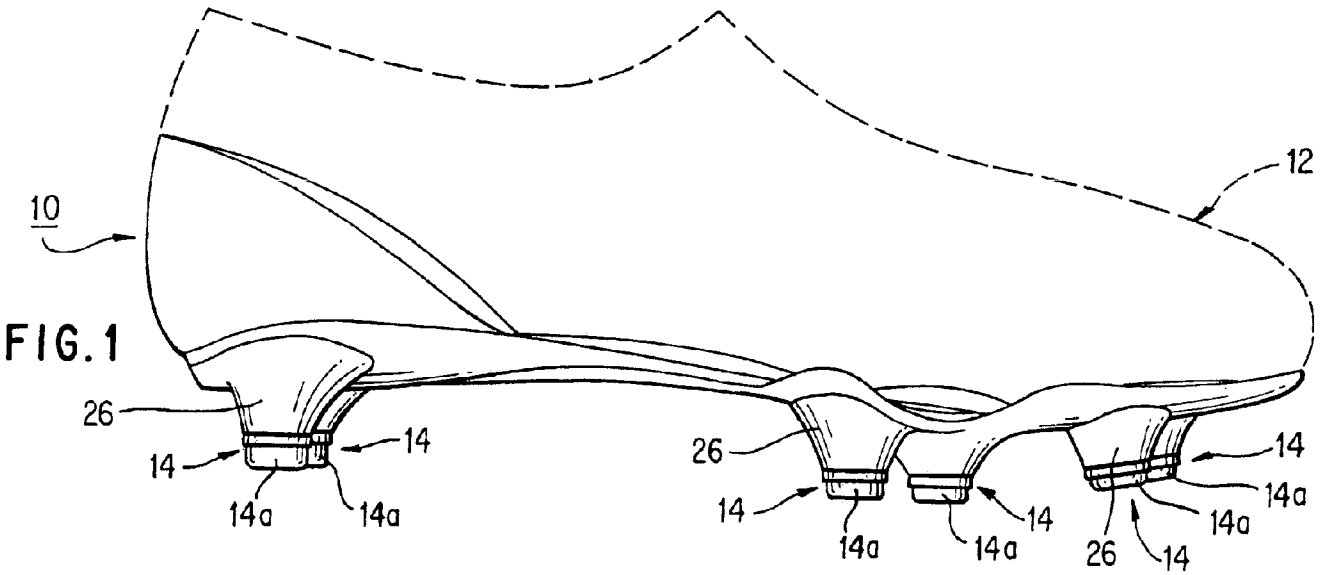
FIG. 1 is a lateral elevational view of a footplate of an article of footwear in accordance with the present invention.

FIG. 1 is a lateral (i.e., from the laterally outer side) elevational view of a footplate 10 of an article of footwear, such as a shoe (particularly, but not necessarily only, an athletic shoe). A right shoe happens to be illustrated by way of example, but this should not be taken as limiting the present invention. In order to assist in the understanding of the subject matter illustrated in the figures, a generic profile of a shoe upper 12 is indicated in phantom in FIG. 1.

For the purposes of the description herein, the article of footwear has a "sole" which includes footplate 10. However, other parts that may be included in a sole, such as a midsole, etc. have been omitted from the drawings for clarity.

Figure 2:
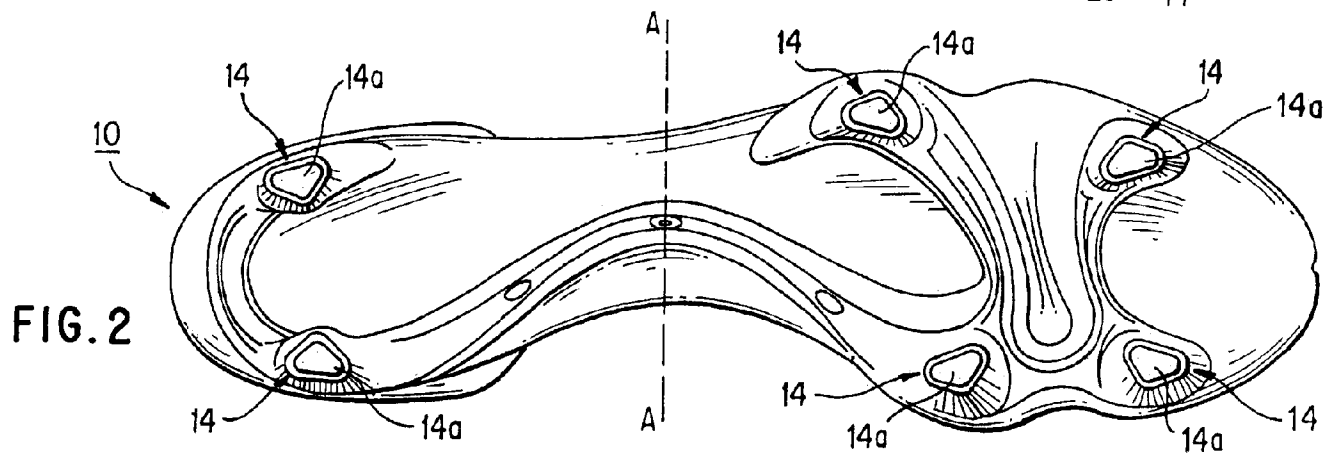
FIG. 2 is a bottom plan view of the footplate illustrated in FIG. 1.

Footplate 10 includes at least one ground-engaging member 14 extending from footplate 10. Commonly, footplate 10 includes a plurality of ground-engaging members 14 distributed over the surface of footplate 10. FIG. 2 illustrates one example of how ground-engaging members 14 may be distributed over the surface of footplate 10.

Generally, the article of footwear can be divided into a forefoot region 11 (generally to the right of line A—A in FIG. 2) and a heel or rearfoot region 13 (generally to the left of line A—A in FIG. 2). Thus, in some cases (as in the embodiment depicted here), the forefoot region 11 may include a greater number of ground-engaging members 14 than the heel region 13. However, it is emphasized that the specific number, location, and/or shape of the ground-engaging members 14 that are provided on footplate 10 may vary widely and still be in accordance with the present invention.

Each ground-engaging member 14 according to the present invention may be a unitary element removably engageable directly with the footplate or sole 10 (see FIG. 4*a*), or may include a raised base portion 26 that is integral with the footplate 10 and a tip 14*a* (see, also, FIG. 4*b*) selectively engaged with the raised base portion 26 in a manner that will be described in detail hereinbelow. It should be noted that in this arrangement, the tip 14*a* and the base portion 26 in combination are ground engaging members.

Each tip 14*a* according to the present invention can be engaged to footplate 10 and disengaged therefrom as desired or required. Each tip 14*a* may have a certain, characteristic height or distance that it extends from footplate 10, as will also be discussed later.

According to one aspect of the present invention, it is desirable to make tips 14*a* engage footplate 10 in a "snap-fit" manner. For the purposes of the description herein, a "snap-fit" engagement between two elements should be understood to mean that engagement therebetween depends on the resiliency of at least one of the elements to effect engagement. For example, a first member may be initially resiliently or otherwise elastically displaced in the process of being engaged with a second member. Subsequently, the first member may resiliently recover its shape, position, orientation, etc. so as to restrain the second member from moving relative to the first member. The aforementioned resilient recovery may sometimes cause a click or a snapping sound, hence the reference to a "snap" fit.

Figure 4A:
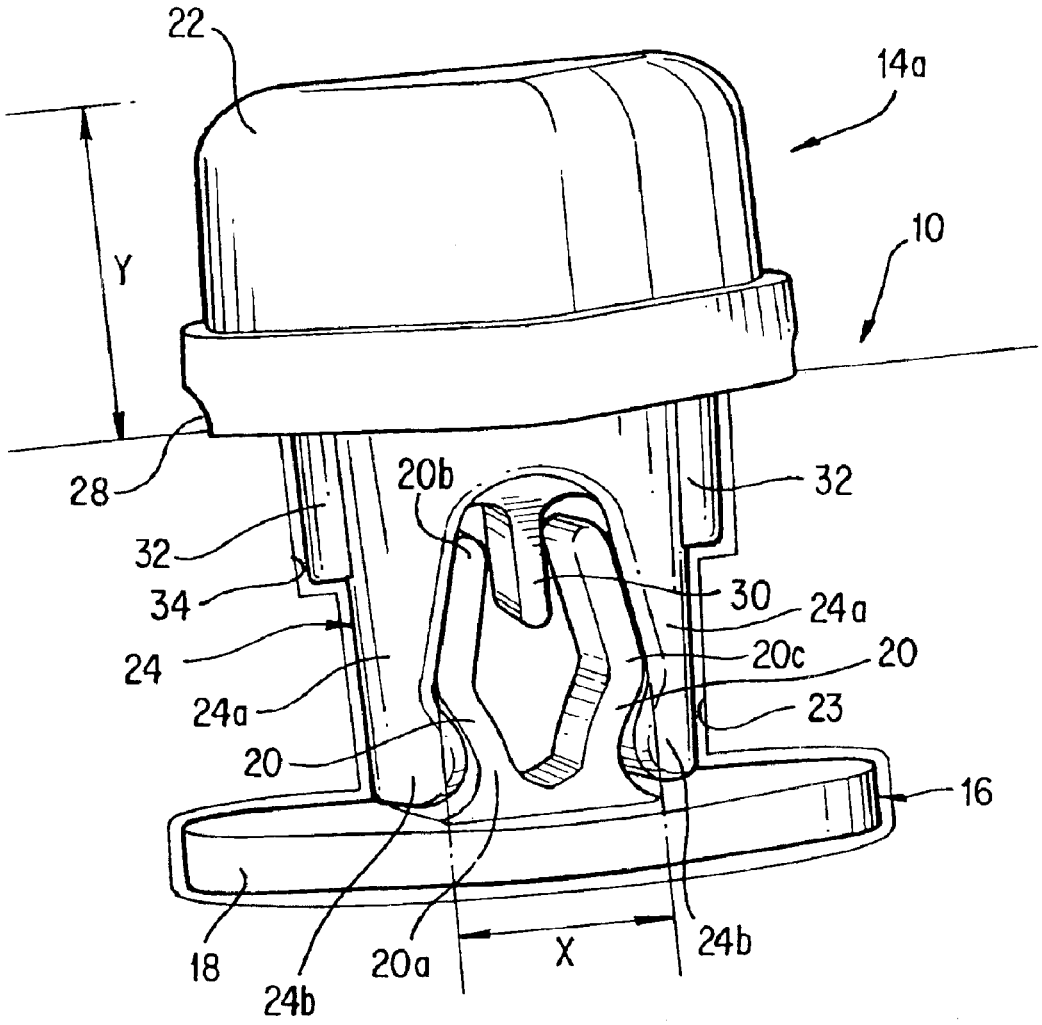
FIG. 4*a* is a perspective view of a tip according to the first embodiment of the present invention engaged with a spring assembly according to the first embodiment of the present invention.

FIG. 4*a* illustrates a tip 14*a* engaged with a spring assembly 16. Spring assembly 16 is associated with a region of footplate 10 with which tip 14*a* is engaged. Spring assembly 16 may include, for example, a base 18 and a plurality of generally elongate spring members 20 extending from base 18. Spring members 20 are preferably formed to be resiliently flexible along a transverse direction, like leaf springs. Spring members 20 may be made from any material exhibiting sufficient resilience and/or resistance to material fatigue. In one example of the present invention, spring members may be made from molded glass-filled nylon 12 or polyethermide. When using glass-filled nylon 12 or polyethermide to make spring members 20, for example, spring members 20 can generally handle a maximum deflection load before fatigue of about 7 pounds each. However, in the arrangement described herein, spring members 20 usually experience deflection loads below 7 pounds.

Figure 4B:
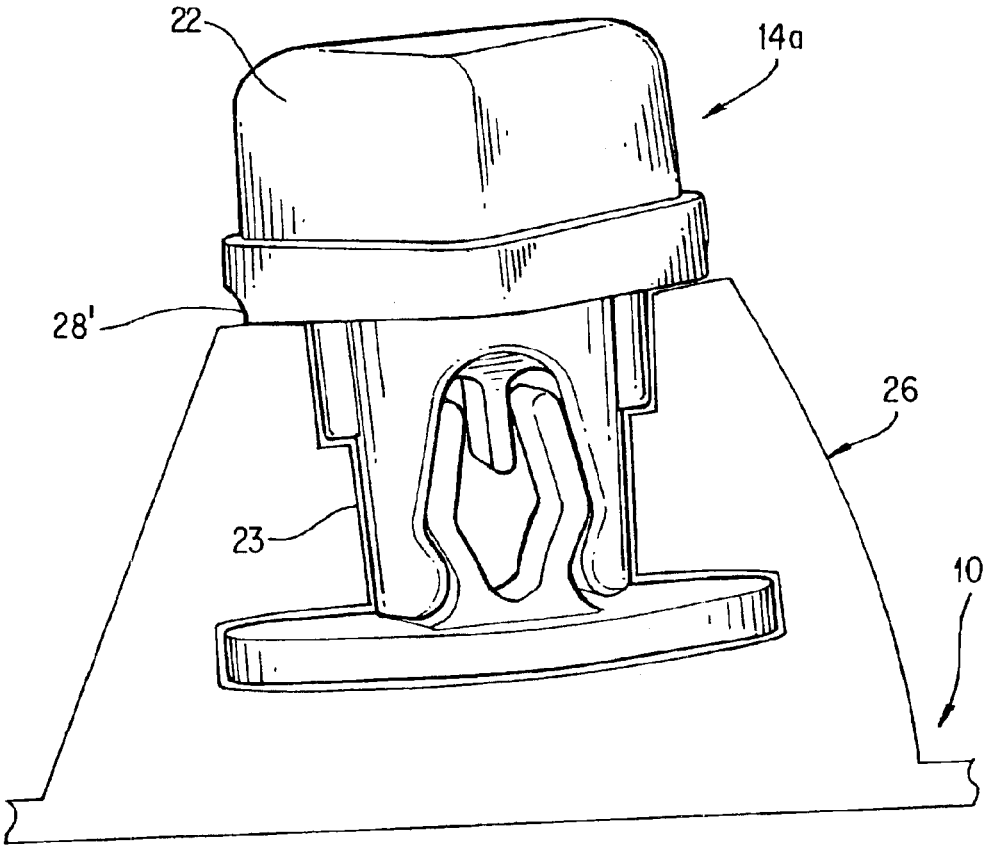
FIG. 4*b* is a perspective view of a tip according to the first embodiment of the present invention engaged with a spring assembly provided in a raised base portion on the sole according to the first embodiment of the present invention.

Generally, spring assembly 16 is fixed relative to footplate 10 in a known and suitable manner. For example, at least a portion of spring assembly 16 may be embedded in footplate 10 by, for example, overmolding the material constituting footplate 10. In a particular example, the material constituting footplate 10 may be molded over base 18 of spring assembly 16 while leaving a bore or other opening 23 in the footplate 10 into which spring members 20 extend. FIGS. 4*a* and 4*b* generally illustrate the form of the material of footplate 10 including bore 23 defined therein.

Generally, tip 14*a* includes a distal-most (with respect to the article of footwear) head 22, and a leg assembly 24 including a plurality of leg members 24*a* extending in generally the same direction from head 22. In the particular example illustrated, tip 14*a* may be provided with two spaced apart leg members 24*a*.

Head 22 may be either axially symmetrical (e.g., conical, frusto-conical, pyramidal, etc.) or may be uniquely shaped for a given application. See, strictly by way of example, the substantially triangular cross-sectional shape of heads 22 in FIG. 2.

In accordance with the present invention, tip 14*a* is engaged with footplate 10 by inserting the leg assembly 24 of tip 14*a* into bore 23. In this regard, it may be desirable to make the exterior surfaces of leg assembly 24 conform closely with interior surfaces of bore 23. This reduces interstitial spaces in which dirt and other debris may lodge. The cooperation between exterior surfaces of leg assembly 24 and interior surfaces of bore 23 should also be sufficiently tolerant so as to facilitate insertion of tip 14*a* in bore 23 without undue hindrance from contact friction and the like.

As seen in, for example, FIG. 4*a*, spring members 20 are preferably curved (or bent) and oriented relative to each other so that a spacing between spring members 20 at first increases then decreases in a direction from the proximal ends of spring members 20 to the distal ends thereof. Thus, the spring members 20 together present an intermediate portion having a maximum width X. The spring members 20 are resiliently flexible (particularly in compression) in a transverse direction (i.e., generally orthogonal to the direction of extension of the spring members 20), like leaf springs.

Respective interior surfaces of leg members 24*a* may be formed in correspondence with an exterior profile of spring members 20, as seen in FIG. 4*a*. Most generally, however, leg members 24*a* have a spacing therebetween that is smaller than the maximum width X between spring members 20. For example, as seen in FIG. 4*a*, leg members 24*a* each include an inwardly protruding distal portion 24*b* which narrows the spacing therebetween to less than width X.

Furthermore, it may be desirable to make a spacing between distal ends of spring members 20 (when spring members 20 are in a neutral, undeflected state) smaller than the distance between protruding portions 24*b*. Also, protruding distal portions 24*b* may be generally rounded or tapered in an appropriate manner to help guide the distal ends of the spring members 20 between protruding distal portions 24*b*. Either or both of these features facilitates receiving the distal ends of spring members 20 between leg members 24*a*.

As a result, when tip 14*a* is pressed into bore 23, the distal portions 24*b* initially force spring members 20 together. This effect is facilitated because the spring members 20 each taper towards each other (with respect to a direction from the point of maximum width X towards the respective distal ends of spring members 20), providing at least somewhat of a wedging effect between leg members 24*a*.

In general, the present invention provides for spring members 20 that are preferably, but not necessarily only, inwardly (i.e., towards one another) resiliently compressed by the respective rigid leg members 24*a* forced thereagainst. In practice, however, some slight outward deflection of leg members 24*a* may occur, within the scope of the presently contemplated invention, in reaction to the force applied to spring members 20.

After the protruding portions 24*b* pass the portion of spring members 20 having the maximum width X therebetween, the compressive force exerted on spring members 20 decreases because the spacing between the spring members 20 decreases. Therefore, spring members 20 resiliently either fully or partially (i.e., so as to remain under resilient compression) recover their neutral position.

Preferably, the resilience of spring members 20 is such that the spring members 20 recover their neutral position relatively suddenly, causing an audible snapping or clicking sound. As mentioned above, this provides a positive indication that the tip 14*a* has become properly (i.e., fully) engaged with spring members 20.

Figure 3A:
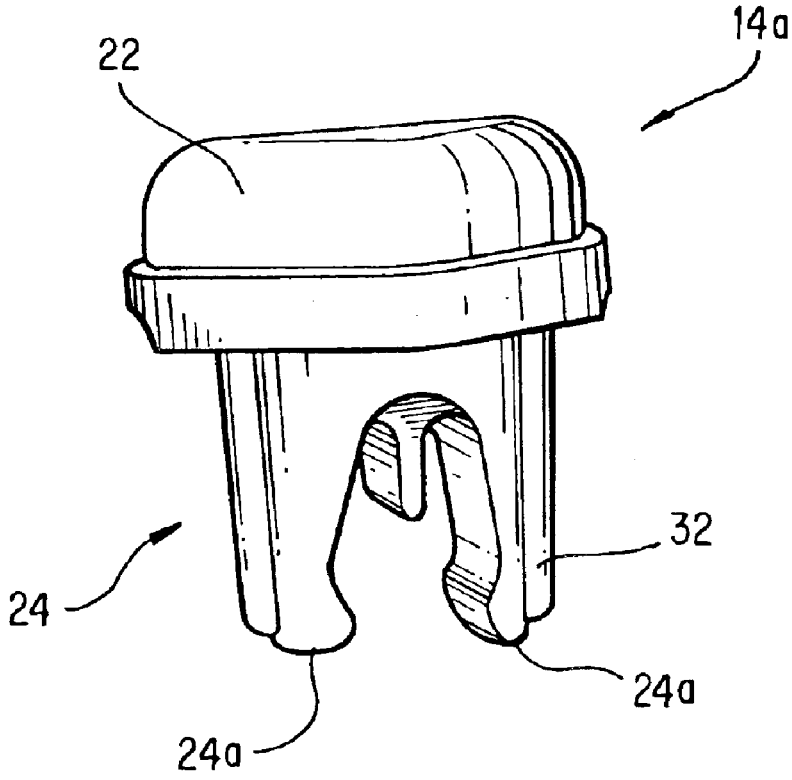
FIG. 3*a* is a perspective view of a tip of a ground-engaging member according to a first embodiment of the present invention.

It is desirable, according to the present invention, to engage tip 14*a* with spring assembly 16 using a linear, substantially non-rotational motion. It is therefore useful, but not necessary, to provide a rotation prevention mechanism to prevent relative rotation between tip 14*a* and spring assembly 16. For example, either the tip 14*a* or the bore 23 can be provided with a rib or spline 32, and the other of the tip 14*a* and the bore 23 can be provided with a cooperating slot or groove 34. By way of example only, FIG. 4 illustrates a rib 32 formed along at least part of the length of leg 24*a*, and a slot 34 formed along at least part of the length of bore 23, although, as mentioned, the reverse arrangement could be used. Alternatively, if desired, the rib 32 may extend the entire height of the tip 14*a* as shown in FIG. 3*a*.

The cooperation between rib 32 and slot 34 has multiple effects. First, when tip 14*a* is inserted into bore 23, rib 32 and slot 34 are located, respectively, so as to align the leg assembly 24 with the spring assembly 16 in the required manner for engagement therebetween. Second, the cooperation of rib 32 and slot 34 prevents relative rotation between tip 14*a* and spring assembly 16 that might cause damaging torsional forces to be applied to spring members 20 during engagement. Additionally, after tip 14*a* is properly engaged, the cooperation between rib 32 and slot 34 prevents subsequent rotation of tip 14*a*, which again could cause damaging torsional forces to be applied to spring members 20 or cause a non-symmetrical head 22 to come out of alignment.

The tip 14*a* can be disengaged from footplate 10 by pulling or prying tip 14*a*, either manually, or using a suitable tool. In particular, a tool can be inserted between an edge of head 22 and the surface of footplate 10. The tool may be specifically adapted for use, or, more preferably, any suitable flat member (including, without limitation, a knife blade, a screwdriver blade, and a coin) can be used. A notch may be provided in head 22 adjacent to the location where head 22 abuts a surface of footplate 10. The notch facilitates insertion of a tool for prying off the tip. See, for example, notch 28 in FIG. 4*a* and notch 28' in FIG. 4*b*, as well as notch 380 in FIG. 8, described further below.

Figure 4C:
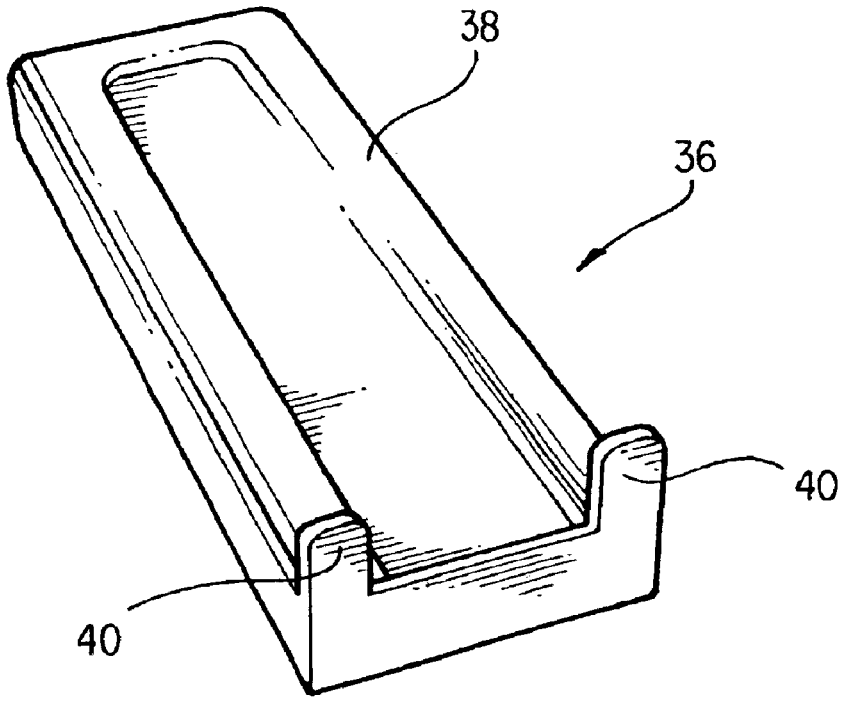
FIG. 4*c* is a perspective view of a prying tool associated with the present invention.
Figure 5:
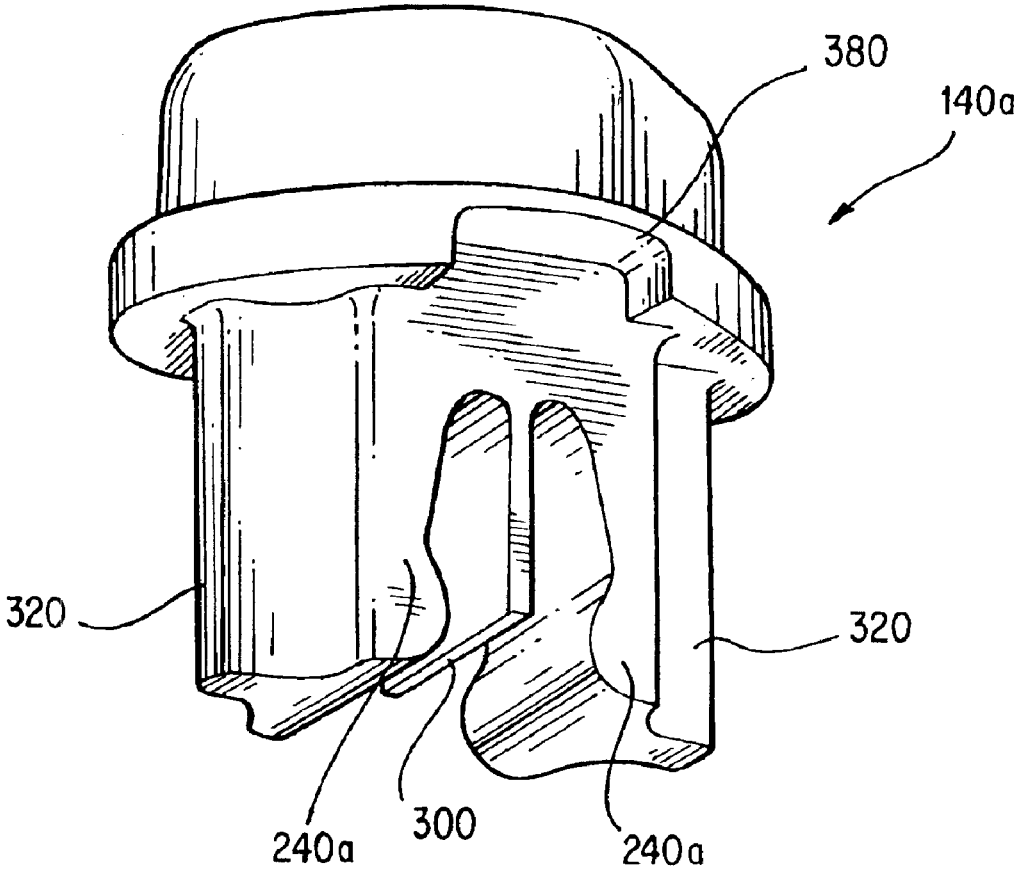
FIG. 5 is a perspective view of a tip of a ground-engaging member according to a second embodiment of the present invention.

FIG. 4*c* illustrates an example of a tool 36 adapted for prying off a tip 14*a*. Tool 36 includes a manually-graspable handle 38 (which can be of any suitable shape) having at least one prying tab 40 extending perpendicularly therefrom. In FIG. 4*c*, two prying tabs 40 are provided for use with a tip 14*a* having two notches (like notch 28(28') in FIGS. 4*a* and 4*b*) provided on opposite sides of head 22 (although a second notch is not shown in FIGS. 4*a* and 4*b*). A lever force is then applied to handle 38 in a direction opposite to the direction in which prying tabs 40 extend to pry tip 14*a* out of engagement. However, as mentioned above, it is contemplated that a tool (such as a coin or screwdriver blade, for example) could be inserted on only one side of the tip 14*a*.

It should be clearly understood from the foregoing that the present invention contemplates and is equally operable by providing a spring assembly on the tip and a leg assembly in association with the footplate, in reverse of the arrangement shown in FIG. 4*a*.

In use, dirt and debris may become lodged or caked in bore 23 in general, and between spring members 20 in particular. Spring members 20 may therefore be prevented from deflecting as required. It is therefore useful, but not necessary, to provide a substantially rigid central rib or other protrusion 30 extending from head 22 between leg members 24*a*. Central rib 30 preferably extends between distal ends of spring members 20 when tip 14*a* is engaged as described above. With this arrangement, central rib 30 can protrude into the space between spring members 20 into order to break up or otherwise dislodge any material (dried mud, for example) deposited therebetween.

Additionally, the central rib 30 controls the deflection of the spring members 20 during the engagement of the stud 14 into the spring assembly 16. During the insertion process, the inwardly extending distal portions 24*b* engage the outside of respective spring members 20 to deflect the spring members 20 inwardly toward each other about their respective base 20*a*. During this process, the central rib 30 extends downward between the spring members 20 and limits the inward bending of the spring members 20 about their bases 20*a* as the tips 20*b* of the spring members 20 are restrained from moving any father inward toward the other spring member 20 in the X-direction. This restraint by the central rib 30 causes the location of the bending in the spring members 20 to change. Specifically, this restraint causes the bending location to shift up from base 20*a* towards the angled middle section 20*c*, as the tips 20*b* of the spring members 20 move upward along the sides of the central rib 30 just before total engagement. This limiting of the bending of the spring members 20 at their base 20*a* is a safety and control factor as it lowers the possibility of fatigue of the spring members 20 at their base 20*a*, and provides a better control of the location of the bending forces.

FIG. 4*a* illustrates tip 14*a* as being engaged at a surface of footplate 10. However, as seen in FIGS. 1 and 4*b*, for example, footplate 10 may be provided with a plurality of raised base portions 26. In this case, each raised base portion 26 has a spring assembly 16 provided therein in accordance with the foregoing description. Using a plurality of base portions 26 in this manner permits the rest of footplate 10 to remain relative thin, and importantly, flexible. Alternatively, when raised base portions 10 are not provided, the entire sole (including footplate 10) should be made comparatively thicker overall in order to accommodate the spring assemblies 16 therein. In a preferred example according to the present invention, raised base portions 26 are unitarily formed with footplate 10, for example, during the process of forming footplate 10.

With the exception of raised base portion 26 illustrated in FIG. 4*b*, all other aspects of FIG. 4*b* are identical to the arrangement shown in FIG. 4*a*, so a repeated detailed description thereof is omitted here.

Figure 3B:
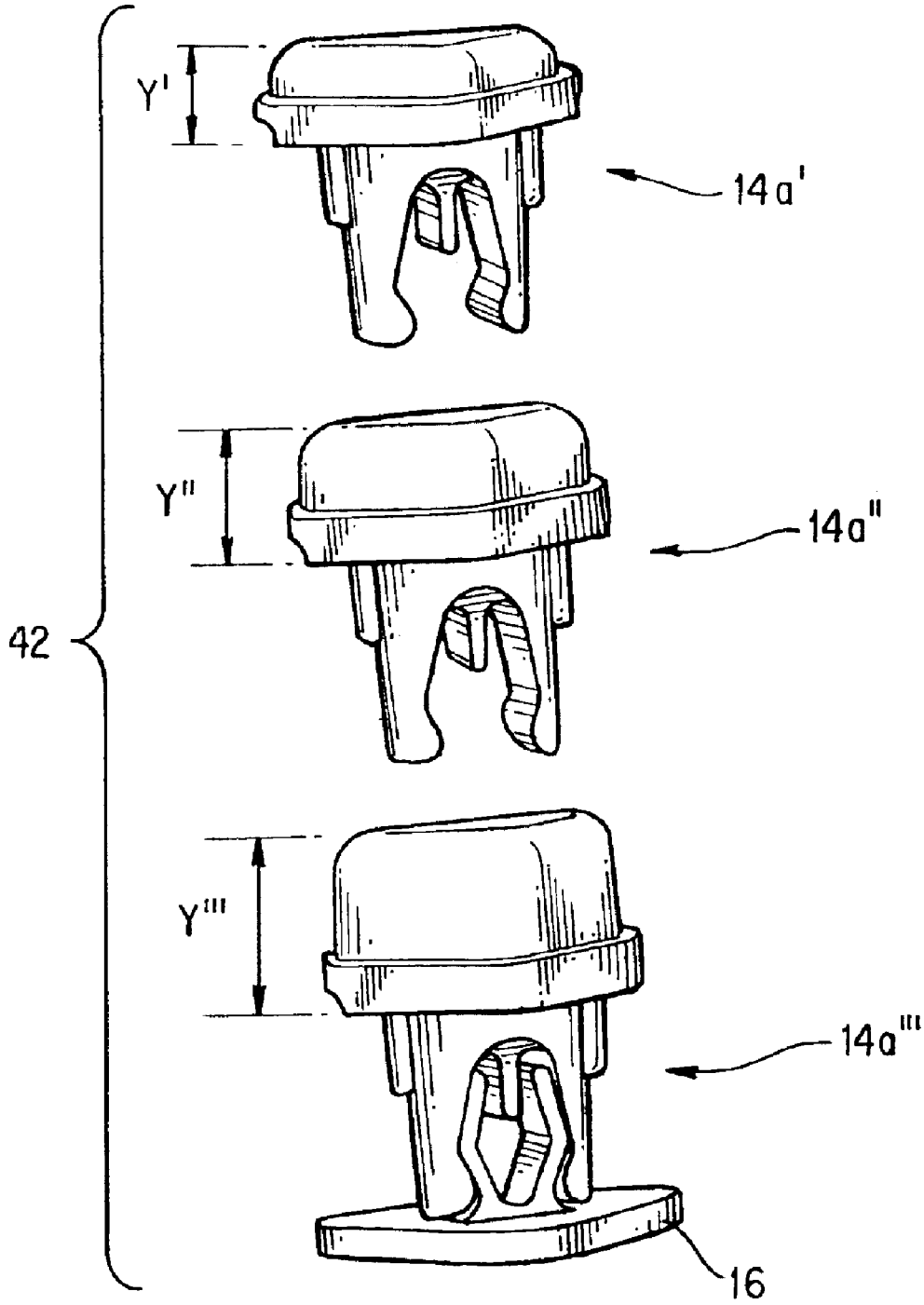
FIG. 3*b* is a perspective view of a set of tips of a ground-engaging member according to the first embodiment of the present invention that can be provided together as part of a kit according to the present invention.

Each tip 14*a* is not only generally replaceable, but one tip 14*a* can be replaced with another tip having a different height Y (see, for example, FIG. 4*a*) (i.e., a distance that tip 14*a* extends from footplate 10 or from raised portion 26 formed on footplate 10). Thus, the ground engaging characteristics of the article of footwear can be also altered by providing a given arrangement of tips 14*a* of varying (or identical) heights. One can therefore provide a kit including the article of footwear and one or more sets of tips, each set having, for example, different heights. Also, a prying tool (such as tool 36 illustrated in FIG. 4*c*) may be provided as part of such a kit. As a result, the ground-engaging characteristics of the article of footwear can be selectively altered by selectively replacing tips 14*a* provided thereon. All of the tips 14*a* in a set may have the identical height, or at least some may have different heights from each other. FIG. 3*b* illustrates a set 42 of tips 14*a*', 14*a*", and 14*a*'", each having the same general structure (as described elsewhere herein) but having differing head heights Y', Y", and Y'". Each of the tips may additionally or alternatively have other differences therebetween, particularly a characteristic relevant to traction performance. For example, the respective tips may have differently shaped head portions.

FIGS. 5–8 illustrate a tip 140*a* and a spring assembly 160 according to a second embodiment of the present invention. Tip 140*a* is similar to tip 14*a* as described above, in at least some respects. One difference is that the tip 140*a* includes a rib or ridge 320 that is relatively thicker than rib 32 of the first embodiment, and extends substantially the entire length of leg 240*a*. In part, rib 320 may serve to further rigidify leg 240*a*, thereby increasing the ability of leg 240*a* to deflect a corresponding spring member (as discussed above). The remaining features of tip 140*a* are similar to those discussed with reference to tip 14*a*.

Figure 6:
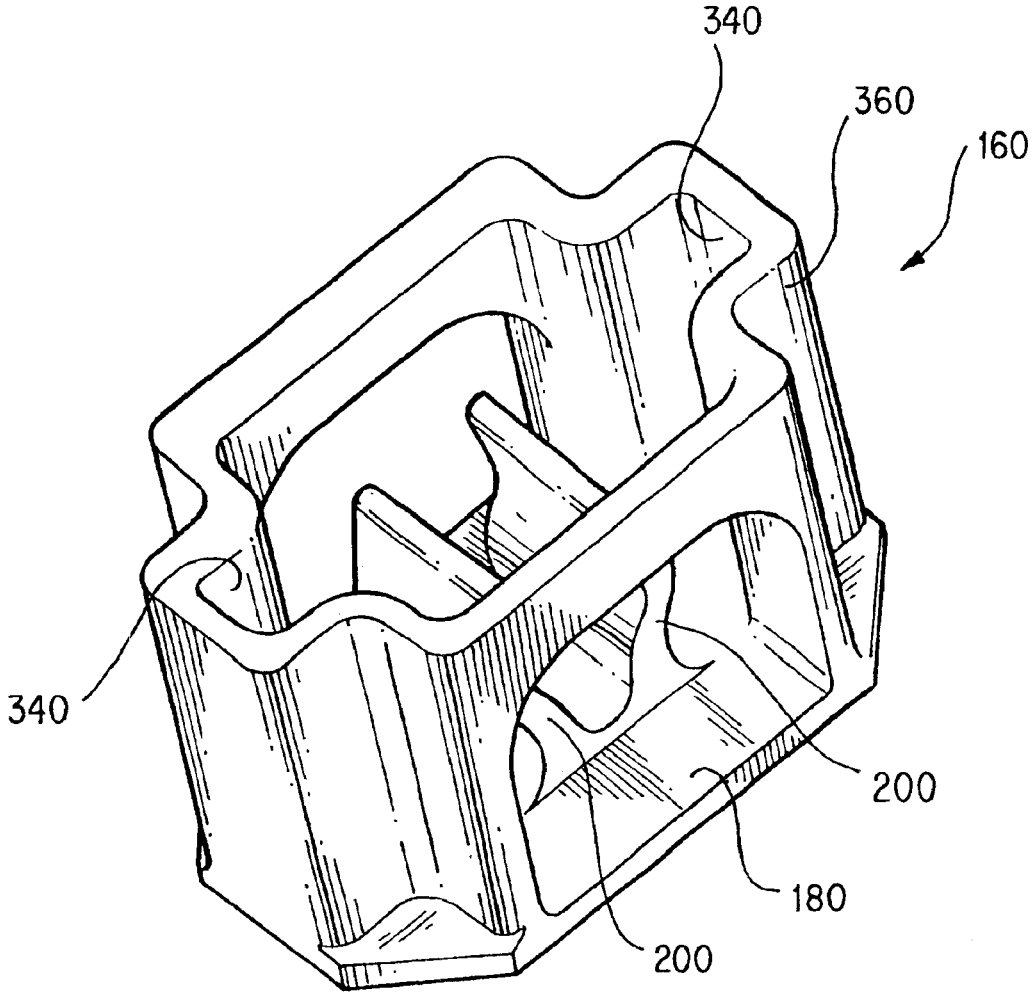
FIG. 6 is a perspective view of a spring assembly according to the second embodiment of the present invention.

FIG. 6 illustrates a spring assembly 160 according to the second embodiment of the present invention. Similar to spring assembly 16 of the first embodiment, spring assembly 160 includes a base 180, from which a plurality of spring members 200 extend. In FIG. 6, two spring members 200 are provided. However, different numbers and arrangements of spring members may be used. Spring members 200 are, for example, arranged in a manner similar to spring members 20 of the first embodiment.

Spring assembly 160 notably includes a wall or frame 360 extending from at least part of the periphery of base 180 in substantially the same direction as spring members 200. The wall 360 may, for example, define a non-cylindrical space therein (as illustrated in FIG. 6). This further retards any tendency for tip 140*a* to rotate relative to spring assembly 360.

Wall 360 also preferably defines a slot or groove 340 therein for cooperating with rib 320. The cooperation between rib 320 and slot 340 has the benefits similar to those described above relative to the first embodiment of the present invention.

The presence of wall 360 may also beneficially serve to protect spring members 200 in an overmolding process (of a type discussed above) and/or provide an increased surface area for bonding with a molding material used to form the footplate.

Other aspects and functionalities of the first embodiment of the present invention discussed above, such as, without limitation, the manner in which legs 240*a* engage spring members 200, the provision of raised base portions on the footplate, the use of a plurality of tips 140*a* having varying heights, the use of a central rib 300, and the contemplation of a kit for permitting selective alteration of tips 140*a*, are applicable to the second embodiment in the same manner as discussed above.

Figure 7:
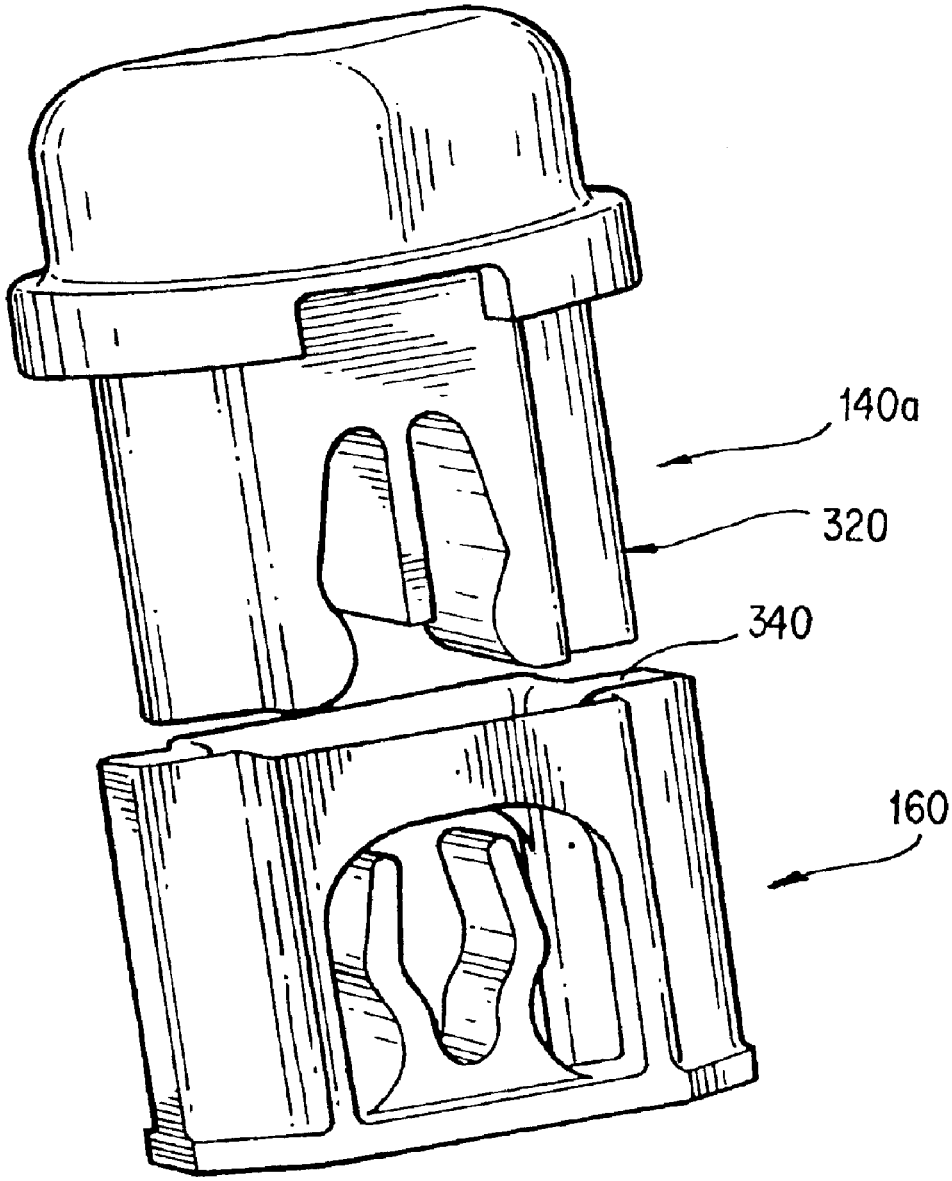
FIG. 7 is an exploded perspective view of the tip and spring assembly according to the second embodiment of the present invention.
Figure 8:
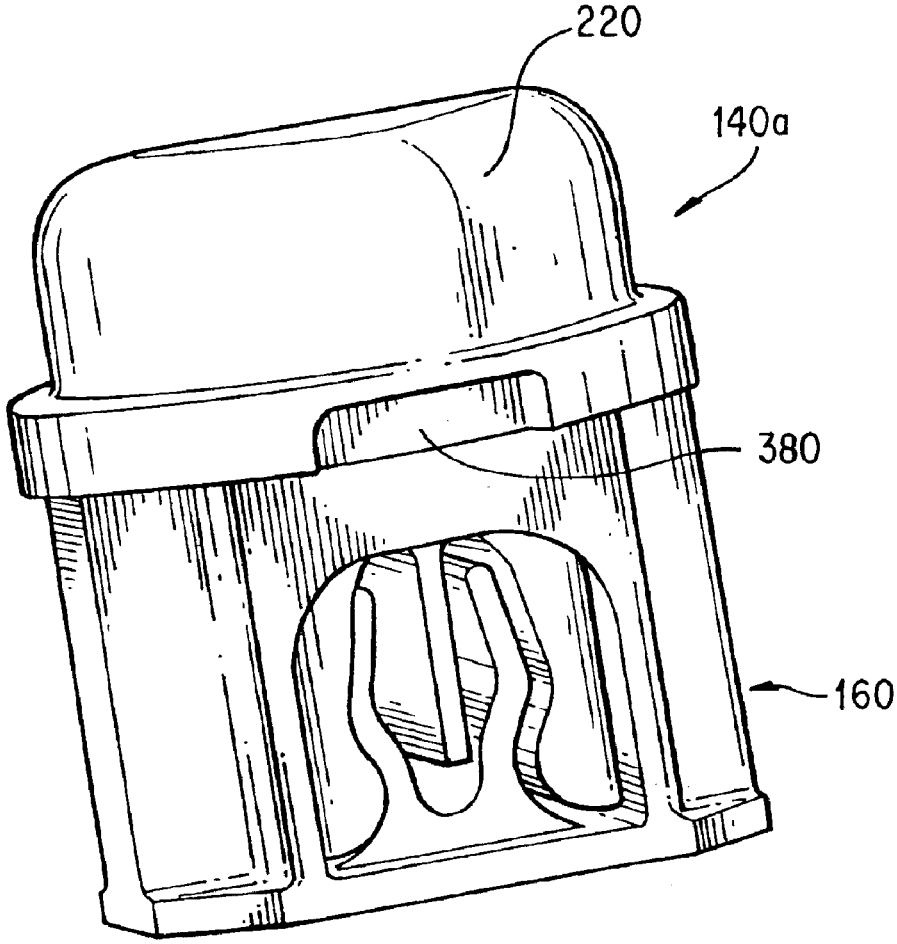
FIG. 8 is a perspective view of the tip and spring assembly according to the second embodiment of the present invention in engagement with each other.

FIG. 7 illustrates tip 140*a* aligned with spring assembly 160 prior to engagement, by aligning rib 320 with slot 340. FIG. 8 is a perspective view illustrating tip 140*a* in engagement with spring assembly 160. As mentioned above, a notch or the like 380 may be provided at an edge of head 220 to facilitate insertion of a disengaging tool and to provide a prying surface. The notch(es) 380 (and 28, discussed above) may have any suitable profile that admits a prying tool (as discussed above) so that the tip 140*a* can be pried off as desired.

Thus, while there have been shown and described features of the present invention as applied to preferred embodiments thereof, it will be understood that various omissions and substitutions and changes in the form and details of the devices illustrated, and in their operation, and in the method illustrated and described, may be made by those skilled in the art without departing from the spirit of the invention as broadly disclosed herein.

What is claimed is:

1. An article of footwear including an upper and a sole, the sole comprising, a receiving portion including a biasing assembly; and a ground-engaging member having a removable tip including a leg member depending therefrom, the leg member configured to resiliently displace a portion of the biasing assembly based on a general linear motion of the leg member causing abutment of the portion of the biasing assembly with the leg member, and the portion of the biasing assembly configured to resiliently recover after the resilient displacement so as to provide a snap-fit engagement; wherein the biasing assembly includes a first biasing member and a second biasing member each being oriented with respect to each other such that, in a direction from a proximal end of the first and second biasing members, respectively, to a distal end of the first biasing member and second biasing member, respectively, a spacing between the first and second biasing members initially increases and then subsequently decreases.

2. The article according to claim 1, wherein said sole includes a footplate from which said ground-engaging member extends.

3. The article according to claim 2, wherein said footplate is made from a resilient plastic.

4. The article according to claim 1, wherein said sole includes a plurality of said receiving portions and a corresponding plurality of ground-engaging members.

5. The article according to claim 4, wherein said sole includes a forefoot region and a heel region, said forefoot region including a greater number of said ground-engaging members than said heel region.

6. The article according to claim 1, wherein said receiving portion includes a raised base having a bore formed therein through which said biasing assembly extends, said removable tip configured for snap-fit engagement with said raised base.

7. The article according to claim 6, wherein said tip includes a head and a pair of spaced apart said leg members both extending in generally the same direction from said head, wherein said biasing assembly is arranged between said pair of leg members, each said leg member being shaped in substantial conformance with a shape of a respective said basing member of said biasing assembly so as to provide a snap-fit engagement between said pair of leg members and said biasing assembly.

8. The article according to claim 7, wherein at least one said leg members has a rib formed on an exterior surface thereof, and an interior wall of said bore has a slot formed therein corresponding to said rib, said rib being positioned on said at least one leg member and said slot being formed in said interior wall of said bore, respectively, so as to align said leg members and said biasing assembly for said snap-fit engagement therebetween.

9. The article according to claim 8, wherein said tip further includes a medial rib extending from said head between said leg members.

10. The article according to claim 9, wherein said medial rib extends between respective distal ends of said pair of biasing members.

11. The article according to claim 2, comprising a plurality of said removable tips, said plurality of tips being interchangeably snap-fit engageable with said receiving portion.

12. The article according to claim 6, wherein said sole includes a plurality of said receiving portions each including a respective raised base, each said raised base extending substantially the same distance from said sole.

13. The article according to claim 6, wherein said sole includes a plurality of said receiving portions each including a respective raised base, each said raised base having a respective said tip in snap-fit engagement therewith, at least two of said tips extending different respective distances from their said respective bases.

14. The article according to claim 6, wherein said sole includes a plurality of said receiving portions each including a raised base, each said raised base having a respective said tip in snap-fit engagement therewith, wherein each of said tips extends substantially the same distance from said respective bases.

15. The article according to claim 1, wherein said biasing assembly comprises glass-filled nylon 12 or polyethermide.

16. An article of footwear including an upper and a sole, the sole comprising, a receiving portion including a biasing assembly; and a ground-engaging member having a removable tip including a leg member depending therefrom, the leg member configured to resiliently displace a portion of the biasing assembly based on a general linear motion of the leg member causing abutment of the portion of the biasing assembly with the leg member, and the portion of the biasing assembly configured to resiliently recover after the resilient displacement so as to provide a snap-fit engagement; wherein the biasing assembly includes first and second said biasing members, said first and second biasing members each defining an obtuse angle and being oriented with respect to each other such that, in a direction from a proximal end of said first and second spring members, respectively, to a distal end of said first and second spring members, respectively, a spacing between said first and second spring members initially increases and then subsequently decreases.

* * * * *